US010697742B2

(12) United States Patent
Dube et al.

(10) Patent No.: US 10,697,742 B2
(45) Date of Patent: Jun. 30, 2020

(54) MULTIPLE PAYLOAD EXPENDABLE DEVICE

(71) Applicant: QUAD-M, INC., McDade, TX (US)

(72) Inventors: Victor James Dube, McDade, TX (US); Tyler Holden, Bastrop, TX (US); Beryl W. Cotton, Lexington, TX (US)

(73) Assignee: QUAD-M, INC., McDade, TX (US)

( * ) Notice: Subject to any disclaimer, the term of this patent is extended or adjusted under 35 U.S.C. 154(b) by 0 days.

(21) Appl. No.: 16/262,799

(22) Filed: Jan. 30, 2019

(65) Prior Publication Data

US 2019/0234718 A1 Aug. 1, 2019

Related U.S. Application Data

(60) Provisional application No. 62/623,724, filed on Jan. 30, 2018.

(51) Int. Cl.
*F42B 5/15* (2006.01)

(52) U.S. Cl.
CPC ..... *F42B 5/15* (2013.01)

(58) Field of Classification Search
CPC ..... F42B 5/15
USPC ..... 102/338, 345, 336, 505, 217
See application file for complete search history.

(56) References Cited

U.S. PATENT DOCUMENTS

| | | | | |
|---|---|---|---|---|
| 5,631,439 A * | 5/1997 | Sallee | F42B 5/08 | 102/202.14 |
| 5,773,749 A * | 6/1998 | Cotton, III | F41A 19/65 | 102/200 |
| 6,513,438 B1 * | 2/2003 | Fegg | F41H 11/02 | 102/336 |
| 6,857,371 B1 * | 2/2005 | Lagrange | F42B 12/48 | 102/377 |
| 7,987,788 B2 * | 8/2011 | Zachrisson | F41F 3/042 | 102/342 |
| 8,250,979 B2 * | 8/2012 | Neff | F42B 3/04 | 102/202.14 |
| 8,365,664 B2 * | 2/2013 | Neff | F42B 3/04 | 102/202.14 |

* cited by examiner

*Primary Examiner* — Reginald S Tillman, Jr.
(74) *Attorney, Agent, or Firm* — Hulsey P.C.

(57) ABSTRACT

This disclosure relates generally to a Multiple Payload Expendable Device consisting of a set of cylindrical multiple payload casings, each payload casing exhibiting circular symmetry fluid passages in relation to firing squibs and voltage coded squib actuating circuit that converts existing single payload expendable device systems to multiple payload expendable device systems.

20 Claims, 3 Drawing Sheets

MULTIPLE PAYLOAD EXPENDABLE DEVICE

CROSS-REFERENCE TO RELATED APPLICATIONS

This application claims priority to U.S. Provisional Patent Application 62/623,724, filed Jan. 30, 2018, which is hereby incorporated by reference in its entirety.

This invention was made with Government support under N68335-17-C-0506 awarded by the Department of the Navy. The Government has certain rights in this invention.

FIELD

This disclosure relates generally to a Multiple Payload Expendable Device consisting of a set of cylindrical multiple payload casings, each payload casing exhibiting circular symmetry fluid passages in relation to firing squibs and voltage coded squib actuating circuit that converts existing single payload expendable device systems to multiple payload expendable device systems.

BACKGROUND

Chaff, originally called Window by the British and Düppel by the Second World War era German Luftwaffe (from the Berlin suburb where it was first developed), is a radar countermeasure in which aircraft or other targets spread a cloud of small, thin pieces of aluminium, metallized glass fibre or plastic, which either appears as a cluster of primary targets on radar screens or swamps the screen with multiple returns.

Modern armed forces use chaff (in naval applications, for instance, using short-range SRBOC rockets) to distract radar-guided missiles from their targets. Most military aircraft and warships have chaff dispensing systems for self-defense. An intercontinental ballistic missile may release in its midcourse phase several independent warheads as well as penetration aids such as decoy balloons and chaff. Aircraft chaff deployers are well known in previous art. Aircraft chaff deployers are utilized to disperse a large cloud of metallic chaff to confuse enemy radar systems.

Previous single payload systems include AN/ALE-29, AN/ALE-40, M130, AN/ALE-47 including the Navy version of the AN/ALE-47. The AN/ALE-47 is a countermeasure dispensing system which is used by all three services, the Army, Air Force, and the Navy. It is a replacement for the Army's M-130, the Air Force's AN/ALE-40, and the Navy's AN/ALE-29/39. These countermeasures systems have been used on, but not limited to the F-4, F-14, F-15, F-16, A-10, F-18 and C-130 aircraft as well as Army and Marine helicopters.

Over the years, as many as 3 billion chaff system cartridges have been installed and operated on military aircraft, not only in the United States but throughout the world. The systems that provide the chaff functionality consistent with the present disclosure, or unquestionably ubiquitous on military aircraft throughout the world. This includes jet aircraft, Single engine aircraft, helicopter aircraft, and other military aircraft where survival of the crew and the air craft may be threatened in a hostile environment.

The effectiveness of a chaff system on a military aircraft, can frequently be a life or death capability, as when deployed when pursued by an enemy missile or aircraft. Accordingly, it is absolutely essential that the systems operate for maximum possible reliability. With the enhanced capabilities of improved electromagnetic radiation capabilities of today's traffic, it is important that chaff deployment systems be simple to maintain and operate.

The Air Force traffic chaff deployers are square. The Navy chief chaff deployers are cylinders. The Air Force system has a divided section. The cartridges are divided in half so that they can just supply two separate charges from one cartridge. The Navy system has never been able to provide the same functionality is the Air Force system. There is the need for a system that is very robust and simple to install. This prevents an untrained technician from improper installation of the chaff deployer.

Because of the inter-operability and variety of potential configurations with the AN/ALE-47, many different types of military vehicles aerial vehicles use the AN/ALE-47 as a chaff to pull your period with this configuration, and operator may change the chaff, circuit board interface within the chaff deployer and the operating instructions for operating the chaff deployer. This enables the AN/ALE-47 to adapt to a variety of different scenarios.

Recent improvements for payload output, configuration and particle size have resulted in improved efficiency and performance of payloads in air expendable countermeasure decoys. As a result, the amount of chaff necessary for a particular mission has reduced significantly. The result of recent efficiency improvements is that a doubling of the effect occurs with the newly designed chaff deployment systems.

The US Air Force currently utilizes a RR-180 dual cartridge payload system which has free volume for payload totaling 2.5 cubic inches for each dual payload. The RR-180 payload cartridge uses the BBU-48 initiator which has an electrical circuit that provides for two voltage coded firing pulses to detonate two 1083 squibs. The Air Force dispenser connector system inherently provides the correct voltage polarity for the dual squib.

A squib is a miniature explosive device used in military applications. It resembles a tiny stick of dynamite, both in appearance and construction, although with considerably less explosive power. Squibs consist of two electrical leads which are separated by a plug of insulating material, a small bridge wire or electrical resistance heater, and a bead of heat-sensitive chemical composition in which the bridge wire is embedded. Squibs can be used for generating mechanical force, or to provide pyrotechnic effects for both film and live theatrics. Squibs can be used for shattering or propelling a variety of materials.

The Navy dispenser connector system does not provide for mechanical squib orientation for correct voltage polarity. The Navy's RR-129 single payload cartridge has a free volume for payload totaling 6.6 cubic inches. If approximately 0.6 cubic inches are allowed for wall material this would permit the Navy RR-129 cartridge to have 3.0 cubic inches for each dual payload which is significantly larger than each of the RR-180 dual cartridge payloads. The RR-129 single payload cartridge is cylindrical whereas the Army and Air Force use square prism shaped payloads. The RR-129 utilizes concentric electrical contacts that do not provide clocking or keying unlike the RR-180 cartridge. The Army and Air Force have dual chaff payload cartridges (RR-180) and the Navy does not (RR-129). The dispensers for the three services are very similar however the dispenser cartridges for the Navy are unique and have different requirements than the other two services.

Currently there is no way to utilize a dual cartridge payload with an existing single payload cartridge system without an expensive retrofit of a large amount of aircraft.

The disclosed subject matter helps to avoid these and other problems.

In essence, the present disclosure provides a squib system that can be installed by a technician to provide enhance chaff deployment properties and functionality using the existing form factor of the AN/ALE-47 system that exist on many aircraft throughout the military the US military.

The subject matter of the present disclosure includes not only chaff, but other devices or instruments for achieving particularly important tactical objectives. This may include, cutting objects and other things that may be deployed in different scenarios depending on the needs of the operational situation.

SUMMARY

The disclosure relates to an improved Multiple Payload Expendable Device in particular a method and apparatus for using a new and improved cartridge and electrical firing circuit that will replace an existing single payload cartridge without costly retrofitting of existing aircraft.

In summary, the present disclosure provides a method, system, and enables an airborne military vehicle to operate with a chaff deployment device for deploying chaff from an airborne vehicle. The chaff deployment devices includes an assembly of multiple chaff deployment cylindrical payload cartridges. The payload cartridges receiving and contain chaff for inducing radiofrequency interference upon being deployed by said chaff deployment device. A plurality of firing squibs for generating a mechanical force for forcing said chaff from said chaff deployment cylindrical payload cartridges. A firing circuit fires the firing squibs for inducing the generation of said mechanical force. A plurality of fluid passages associated with the payload cartridges transmit the mechanical force to the chaff. The plurality of fluid passages are in fluid communication with the firing squibs. The plurality of fluid passages are formed in circular symmetry with respect to the longitudinal axis of the multiple chaff deployment cylindrical payload cartridges. The firing circuit applies a first low voltage electrical signal to a first one of the firing squibs for deploying chaff from one of the multiple chaff deployment payload cartridges. The firing circuit apples a second higher voltage electrical signal to a second one of the plurality of firing squibs for deploying chaff from a second one of the multiple chaff deployment payload cartridges.

The quintessential aspects of novelty for the present disclosure include: (1) the circular symmetry that prevents installation errors; (2) the dual voltage actuation circuit is also novel. The dual voltage actuation circuit also present prevents insulation actuation errors; and (3) above all, the presently disclose systems provides the novel aspects of a dual chaff deployer with the existing hardware.

There is no need to change the existing hardware in order to incorporate the functionality and structures of the presently disclose subject matter. This is very important, because there are thousands of aircraft across the world that use this system. The ability to backfill at existing AN/AK-47s with the presently disclose systems system has the potential of saving billions of dollars in hardware and software expenses for military applications.

The main advantage of using the invention is the provision of a novel means of actuating a Multiple Payload Expendable Device through a novel electrical circuit and physical construction that permits use of said Multiple Payload Expendable Device that interfaces with the existing AN/ALE-47 System without modification to the system.

The invention satisfies the following requirements: A) Utilizes existing 2 conductor (wire) firing circuit. B) Provides two (2) separate payload initiation capability sequentially at two (2) different firing times. C) Fits into the Navy round cartridge form factor. D) Has low unit cost. E) Satisfies open circuit requirements after ignition (>500 Ohms). F) Enables polling capable circuitry (250 ma). G) Satisfies Safe Hazards of Electromagnetic Radiation to Ordnance (HERO) (MIL-STD-464) rating, and H) is compatible with the existing AN/ALE-47 countermeasure dispensing system hardware and software.

BRIEF DESCRIPTION OF THE DRAWINGS

A more complete understanding of the invention and the many attendant advantages thereof will be readily appreciated as the same becomes better understood by reference to the following detailed description, when considered in connection with the accompanying drawings wherein.

DESCRIPTION OF THE PREFERRED EMBODIMENTS

Figure 1:
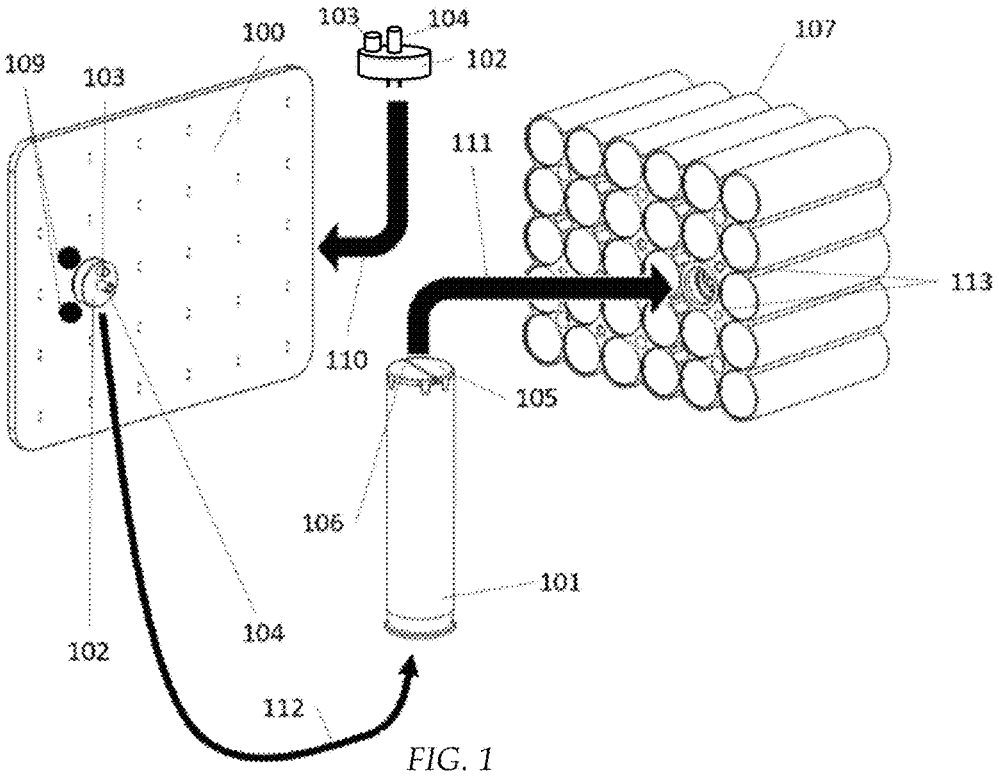
FIG. 1 is an exploded view of the Multiple Payload Expendable Device.

In one embodiment, the apparatus of the invention includes fabricating a Multiple Payload Expendable Device that interfaces with the current Navy AN/ALE-47 countermeasure dispenser system. The term "payload" in this disclosure can include chaff, flares, radio frequency decoys, and other deployable objects, fluids, gasses or solids. The invention consists of the AN/ALE-47 Electronics System, a breech plate printed circuit board with a set of dual ignitor squib assemblies plugged into the printed circuit board, a dispenser block composed of an array of tubes, and a set of payload cartridges. The set of payload cartridges are inserted into the cylindrical tubes in the dispenser block from the breech side of the dispenser block. The breech plate printed circuit board contains a matrix of conductive traces that are plugged into two electrical socket contacts on each dual ignitor squib assembly. Two pins on the dual squib ignitor assembly plug into the socket contacts. The breech plate printed circuit board with squib assemblies installed is attached to the breech side of the dispenser block. Each squib assembly plugged into the circuit board fits into the breech side of each tube in the dispenser block in a plug-like fashion behind each of the dual payload cartridges. Circular orientation of each of the RR-129 style dual payload cartridges is arbitrary since gas passages are fabricated in the cartridge that lead squib produced gasses from a centrally located squib to one payload chamber and an outer concentrically located squib (relative to the central squib) to the other of the payload chambers. Connection to the firing circuit of the squib assemblies is also arbitrary since voltage coding (described later in detail) is used to separately actuate each squib. The breech plate printed circuit board also has locating bosses that are inserted into locating holes in the dispenser block that align the multiple squib assemblies with the bores of each of the tubes in the dispenser block.

Voltage coding works as follows. The existing AN/ALE-47 Sequencer emits two output pulse voltages separated in time for igniting (firing) a multiple squib system (e.g. the Air Force RR-180). The first pulse is 5.5 VDC to 6.8 VDC for 20 milliseconds. The second 20 millisecond pulse is not voltage regulated and depends on the 28 VDC bus voltage applied to the sequencer squib firing circuits. The minimum voltage output will be about 12 VDC. The squib minimum voltage available from the AN/ALE-47 System for firing the high side squib will be greater than 14 VDC for the Navy squib (assumes squib current of 4 amperes). The AN/ALE-47 Sequencer current limits to about 5.5 amperes so the currents in the squibs will not be excessive with AN/ALE-47 Sequencer input 28 VDC bus voltage as high as 32 VDC. The first low voltage pulse fires one squib and a second, higher voltage pulse fires a second squib.

A dual Zener diode circuit provides voltage coding actuation margin between the low voltage requirement of 4 VDC and the standoff voltage of 6.2 VDC while permitting high voltage (>12 VDC) actuation of the second squib and has no noise (i.e. extraneous signal) voltage susceptibility issues. This approach does not require any changes to the AN/ALE-47 Sequencer hardware to fire multiple squibs at different times. The only change required is in the controller software to emit voltage varying signals to each squib firing circuit. This design approach minimizes components and is low in cost.

A voltage signal is applied to the circuit from the AN/ALE-47 Sequencer on the order of 5.5 to 6.8 VDC. Voltage polarity of this signal does not matter. Voltage polarity insensitivity is important in the invention as it relaxes any connector polarity issues which tends to lower the cost of the system as well as reducing assembly risk by inexperienced technicians. Applied current should be sufficient to properly heat the squib ignitor heater element. Oppositely polarized (but in series) Zener diodes prevent the low voltage signal from passing through the squib ignitor (a resistive element) in series with the Zener diodes. However, the lower voltage/current signal passes through squib ignitor (also a resistive element) that is wired in parallel with the Zener diode protected ignitor causing it to heat and ignite one squib and deploy one cartridge payload while preventing the Zener diode protected other squib from firing.

Next, a higher voltage signal is applied to the firing circuit from the AN/ALE-47 Sequencer on the order of greater than 14 VDC. Current is sufficient to properly heat the other squib ignitor heater element. As stated earlier voltage polarity of this signal does not matter. Opposed polarity Zener diodes now permit the higher voltage signal to pass through the Zener diode protected squib ignitor (a resistive element) causing it to heat and ignite the squib and deploy the next cartridge payload. In addition, since the unprotected squib ignitor was previously heated and fused, the circuit is broken across the unprotected squib ignitor thus driving all actuating current through the Zener diodes and the protected squib ignitor.

Orientation of each cartridge is arbitrary since circular symmetry gas passages are fabricated in the cartridge that lead squib produced gasses from a central squib to one payload chamber and an outer concentrically located squib to the other of the payload chambers. This geometry of gas passages permits foolproof assembly between the squib assemblies and the main cartridge bodies.

In one embodiment, the apparatus of the invention includes fabricating a Multiple Payload Expendable Device that interfaces with the current Navy AN/ALE-47 countermeasure dispenser system. As illustrated in FIG. 1, the invention consists of the AN/ALE-47 Electronics System (not shown), a breech plate printed circuit board 100, a set of dual payload cartridges 101, a set of dual squib ignitors 102 plugged into printed circuit board 100 and a dispenser block 107. The set of payload cartridges 101 are inserted into the breech side dispenser block 107 as indicated by arrow 111. Breech plate printed circuit board 100 contains a matrix of dual squib ignitor assemblies 102 plugged into the breech plate printed circuit board 100, as indicated by arrow 110. As breech plate printed circuit board 100 with a matrix of dual squib ignitor assemblies 102 is attached to the breech side of dispenser block 107 as indicted by the arrow 112, each of the dual squib ignitor assemblies 102 are inserted into the breech end of tubes in dispenser block 107 and in communication with the breech side of cartridge 101 with squib 103 automatically aligned with the gas passage of cartridge payload 105 and squib 104 automatically aligned with the gas passage of cartridge payload 106.

The existing AN/ALE-47 Sequencer emits two output pulse voltages for igniting (firing) a dual squib system (e.g. the Air Force RR-180). The first pulse is 5.5 VDC to 6.8 VDC for 20 milliseconds. The second 20 millisecond pulse is not voltage regulated and depends on the 28 VDC bus voltage applied to the sequencer squib firing circuits. The AN/ALE-47 minimum voltage for firing the high side squib will be about 14 VDC for the Navy squib (assumes squib current of 4 amperes) for 28V bus voltage as low as 17 VDC. The AN/ALE-47 Sequencer current limits to about 5.5 amperes so the currents in the squibs will not be excessive with AN/ALE-47 Sequencer input 28 VDC bus voltage as high as 32 VDC. This method of actuation is called voltage coding. The first low voltage pulse fires one squib and a second, higher voltage pulse fires a second squib.

With the subject matter of the present disclosure it is possible to alternate and control the selection of the firing of the chest cartridge is either in sequence or in alternating positions on the chaff display system. All of this is software control.

Figure 2A:
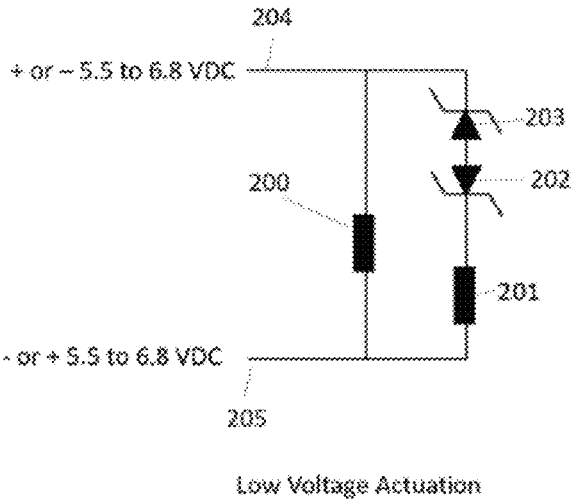
FIG. 2A is a schematic diagram of the actuating circuit operating in low voltage mode.
Figure 2B:
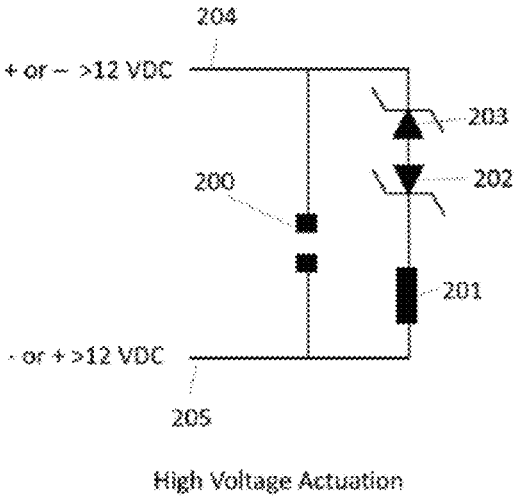
FIG. 2B is a schematic diagram of the actuating circuit operating in high voltage mode.

As illustrated in FIG. 2A and FIG. 2B, a dual Zener diode circuit provides voltage coding actuation margin between the low voltage requirement of 4 VDC and the standoff voltage of 6.2 VDC while permitting high voltage (>14 VDC) actuation of the second squib and has no noise (i.e. extraneous signal) voltage susceptibility issues. This approach does not require changes to the AN/ALE-47 Sequencer and minimizes components and cost.

In FIG. 2A a voltage signal is applied to terminals 204 and 205 from the AN/ALE-47 Sequencer on the order of 5.5 to 6.8 VDC. Voltage polarity of this signal does not matter. Voltage polarity insensitivity is important in the invention as it relaxes any connector polarity issues which tends to lower the cost of the system as well as reduce assembly risk by inexperienced technicians. Applied current should be sufficient to properly heat squib ignitor 200 heater element. Zener diodes 202 and 203 prevent the low voltage signal from passing through squib ignitor 201 (a resistive element). However, the voltage/current signal passes through squib ignitor 200 (also a resistive element) causing it to heat and ignite squib 103 and deploy cartridge payload 105.

In FIG. 2B a higher voltage signal is applied to terminals 204 and 205 from the AN/ALE-47 Sequencer on the order of greater than 14 VDC (preferably 16 VDC). Current should be sufficient to properly heat squib ignitor 201 heater element. As in FIG. 2A polarity of this signal does not matter. Zener diodes 202 and 203 now permit the higher voltage signal to pass through squib ignitor 201 (a resistive element) causing it to heat and ignite squib 104 and deploy cartridge payload 106. It is also noted that since squib ignitor 200 was previously heated and fused, the circuit is broken across element 200 thus driving all actuating current through Zener diodes 202/203 and squib ignitor 201.

This circuit can be extended to cover additional dispenser channels if desired. For example, rather than two squibs there can be three, four or more squibs concentrically located in relation to concentrically located payloads in the multiple payload cartridge and separated by concentrically located walls. Firing circuit operation is accomplished by adding additional Zener diode/squib combinations that have increasingly higher Zener voltages of, for example, 6.2V, 7.8V, 8.2V etc. respectively. Actuation of the Zener diode/squib combinations is accomplished by applying a progressively higher voltage signal starting at, for example, 6.2V, and advancing to 7.8V, 8.2V etc. respectively.

Figure 3B:
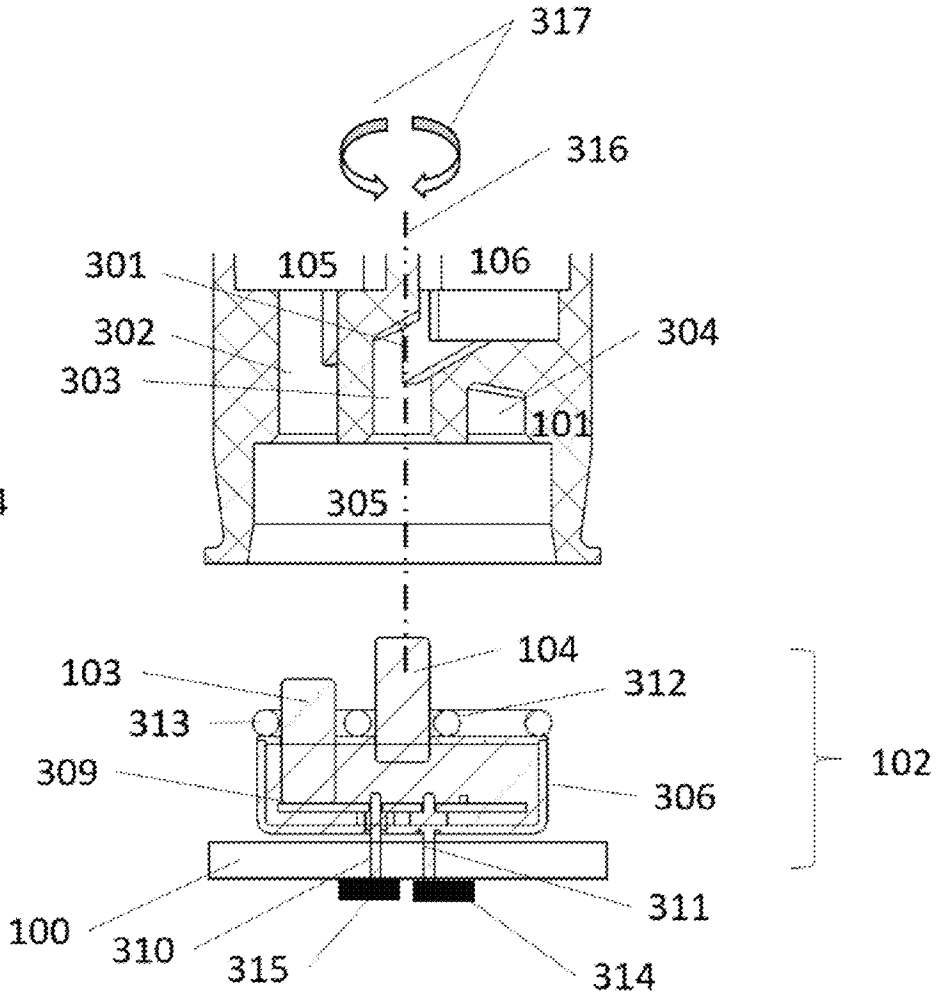
FIG. 3B is a side cutaway view of the gas passages of the main cartridge body with the squib/firing circuit assembly prior to assembly.
Figure 3A:
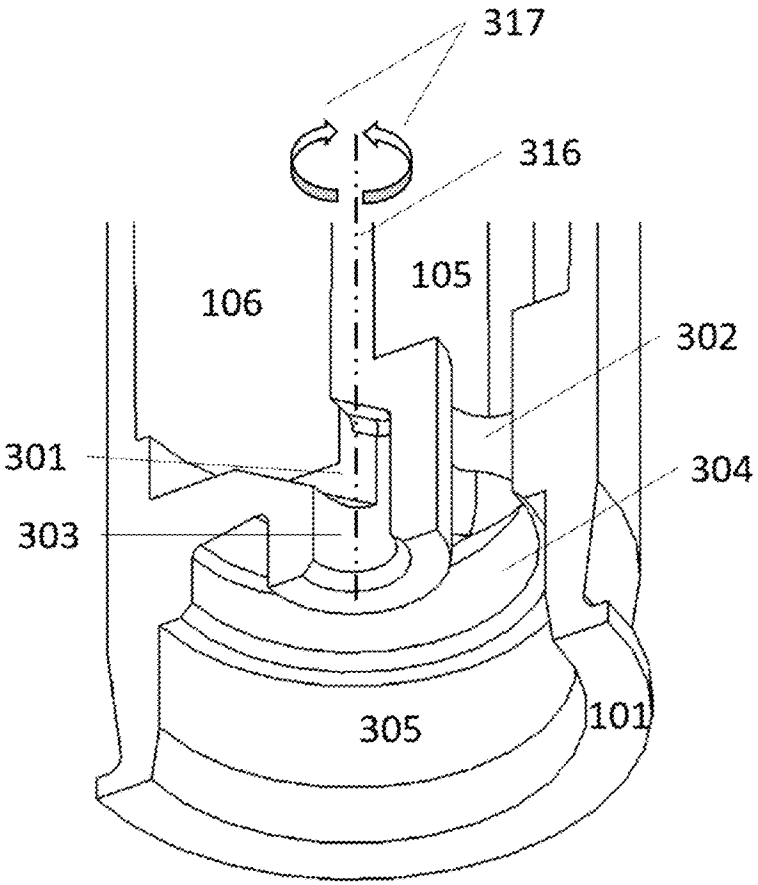
FIG. 3A is a cutaway view of the gas passages of the main cartridge body.

FIG. 3A is a cutaway of payload cartridge 101 illustrating payload chambers 105 and 106. Gas passage 301 is in communication with payload chamber 106. Squib receptacle 303 is in communication with gas passage 301. Gas passage 302 is in communication with payload chamber 105. Concentric squib receptacle 304 is in communication with gas passage 302. Cylindrical volume 305 receives dual squib assembly 102. Circular orientation 317 of the payload cartridge 101 (about its cylindrical long axis 316) is arbitrary since the construction of the gas passages 301/303 and 302/304 in payload cartridge 101 has circular symmetry.

FIG. 3B is an alternative cutaway view of squib assembly 102, payload cartridge 101 prior to assembly illustrating payload chambers 105 and 106. Gas passage 301 is in communication with payload chamber 106. Squib receptacle 303 is in communication with gas passage 301. Gas passage 302 is in communication with payload chamber 105. Concentric squib receptacle 304 is in communication with gas passage 302. Cylindrical volume 305 receives dual squib assembly 102. Circular orientation 317 of the payload cartridge 101 (about its cylindrical long axis 316) is arbitrary since the construction of the gas passages 301/303 and 302/304 in payload cartridge 101 has circular symmetry.

Dual squib assembly 102 is composed of a housing 306 with a central squib 104 (which corresponds to squib ignitor 200), an outer squib 103 (which corresponds to squib ignitor 201), circuit board 309 which contains all the circuit elements illustrated in FIGS. 2A and 2B, electrical contact pins 310 and 311, gas sealing O-ring 312 (corresponding to squib 104), and gas sealing O-ring 313 (corresponding to squib 103). Circuit board 100 contains electrical traces 314 and 315 that are in electrical communication with pins 310 and 311.

Figure 3C:
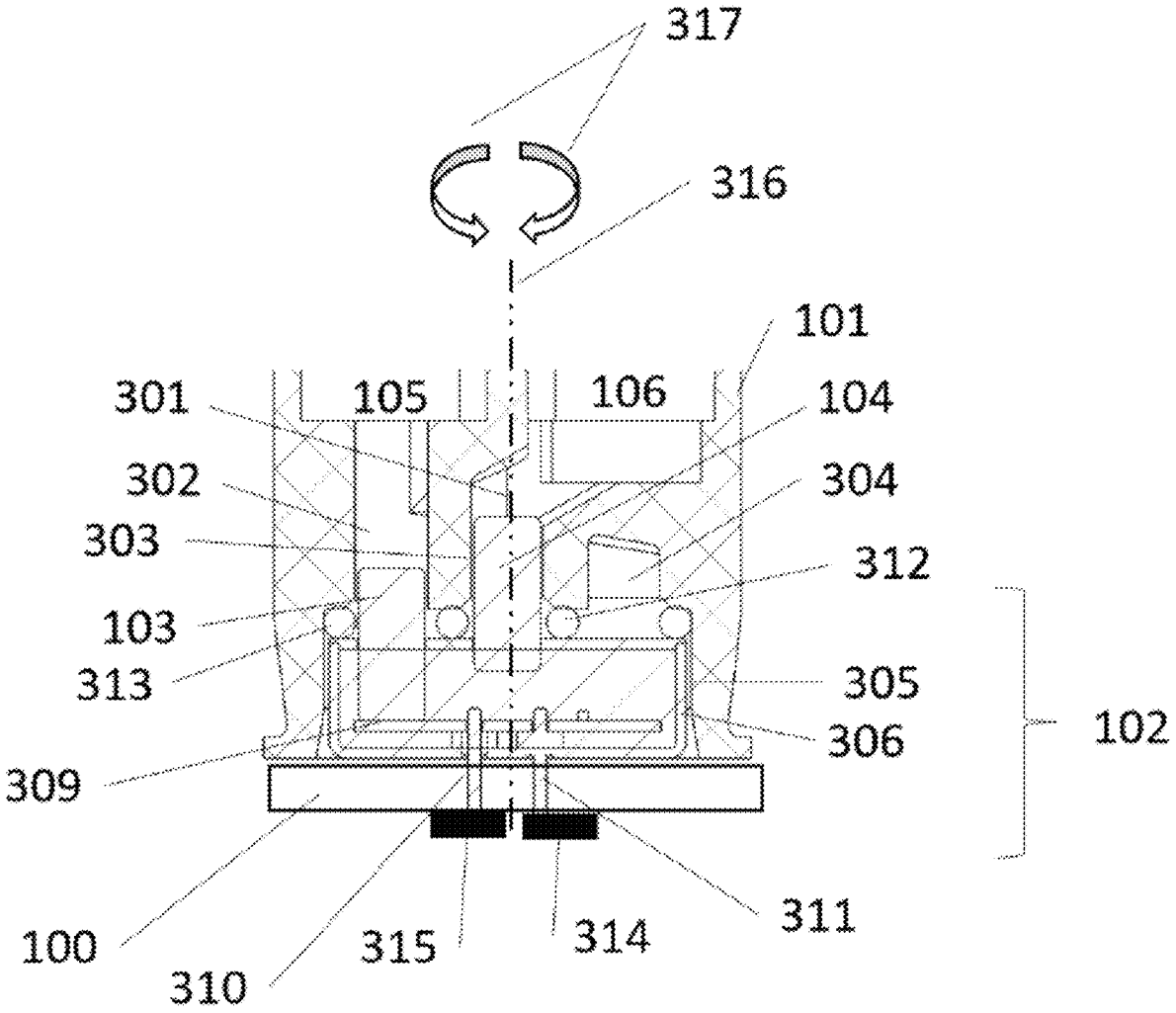
FIG. 3C is a cutaway view of the gas passages of the main cartridge body with the squib/firing circuit assembly attached to the main cartridge body.

FIG. 3C is an assembled cutaway view of dual squib assembly 102 in electrical communication with circuit board 100 and in mechanical/fluid communication with payload cartridge 101. In operation of the first payload, a first low voltage signal is applied across pins 310 and 311, squib 104 (located in receptacle 303 and sealed off with O-ring 312) is ignited and blows hot gasses through gas passage 301 into payload chamber 106 igniting/blowing the charge contained in payload chamber 106. The orientation of pins 310 and 311 (due to voltage coding) and the circular orientation 317 of the payload cartridge 101 (about its cylindrical long axis 316) is arbitrary since the construction of the gas passage 301/303 in payload cartridge 101 has circular symmetry.

In operation of the second payload chamber 105, a second high voltage signal is applied across pins 310 and 311, squib 103 (located in receptacle 304 and sealed off with O-ring 313) is ignited and blows hot gasses through gas passage 302 into payload chamber 105 igniting/blowing the charge contained in payload chamber 105. The orientation of pins 310 and 311 (due to voltage coding) and the circular orientation 317 of the payload cartridge 101 (about its cylindrical long axis 316) is arbitrary since the construction of the gas passage 302/304 in payload cartridge 101 has circular symmetry.

To summarize, firing circuits are voltage polarity insensitive e.g. a positive voltage may be applied to either squib contact pin with the negative applied to the remaining pin. This allows a technician installing a squib on the circuit board to ignore squib polarity thus eliminating an incorrectly installed squib.

Mechanical orientation of the squib to the cylindrical payload cartridge is installation insensitive eliminating the need for a technician to mechanically orient the squib to the payload during installation.

In summary, the present disclosure provides a method, system, and enables an airborne military vehicle to operate with a chaff deployment device for deploying chaff from an airborne vehicle. The chaff deployment devices includes an assembly of multiple chaff deployment cylindrical payload cartridges. The payload cartridges receiving and contain chaff for inducing radiofrequency interference upon being deployed by said chaff deployment device. A plurality of firing squibs for generating a mechanical force for forcing said chaff from said chaff deployment cylindrical payload cartridges. A firing circuit fires the firing squibs for inducing the generation of said mechanical force. A plurality of fluid passages associated with the payload cartridges transmit the mechanical force to the chaff. The plurality of fluid passages are in fluid communication with the firing squibs. The plurality of fluid passages are formed in circular symmetry with respect to the longitudinal axis of the multiple chaff deployment cylindrical payload cartridges. The firing circuit applies a first low voltage electrical signal to a first one of the firing squibs for deploying chaff from one of the multiple chaff deployment payload cartridges. The firing circuit apples a second higher voltage electrical signal to a second one of the plurality of firing squibs for deploying chaff from a second one of the multiple chaff deployment payload cartridges.

The chaff deployment device provides a first low voltage electrical signal and said second low voltage electrical signal are of arbitrary polarity both independently and to one another. The chaff deployment device also provides a first low voltage electrical signal and a second low voltage electrical signal provide controllable inputs for firing the firing squibs at controllably different times. The chaff deployment device further provides a firing circuit for generating said first low voltage electrical signal and said second low voltage electrical signal provide an open circuit condition of at least 500 ohms following generation and transmission of the first low voltage electrical signal or said second low voltage electrical signal.

The chaff deployment device provides a firing circuit that is voltage polarity insensitive for eliminating errors upon installing said firing squibs to said assembly of multiple chaff deployment cylindrical payload cartridges. The chaff deployment device uses chaff objects from the group consisting of electromagnetic radiation absorbing elements, electromagnetic radiation reflecting elements, physical objects for interfering with approaching missiles or other flying devices, glass objects capable of breaking and forming cutting surfaces upon contact with the ground or other objects, and other obstructive objects capable of interfering with attempts to hit or damage the flying vehicle deploying said objects.

The chaff deployment device provides the assembly of multiple chaff deployment cylindrical payload cartridges permits mechanical orientation of said squibs to said cylindrical payload cartridges to be insensitive to cylindrical orientation, thereby eliminating the need for mechanically orienting said squibs to said cylindrical payload cartridges during assembly. The chaff deployment device of claim 1, wherein said assembly of multiple chaff deployment cylindrical payload cartridges permits conversion of a prior existing single payload air expendable decoy device to use said assembly of multiple chaff deployment cylindrical payload cartridges within the existing hardware and software systems of a military vehicle.

It will be apparent to those skilled in the art that various modifications and variations can be made in the present disclosure without departing from the scope or spirit of the disclosure. Other embodiments of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

What is claimed is:

1. A chaff deployment device for deploying chaff from an airborne vehicle, comprising:

an assembly of multiple chaff deployment cylindrical payload cartridges, said payload cartridges for receiving and containing chaff for inducing radiofrequency interference upon being deployed by said chaff deployment device;

a plurality of firing squibs for generating a mechanical force for forcing said chaff from said chaff deployment cylindrical payload cartridges;

a firing circuit for firing said firing squibs for inducing the generation of said mechanical force;

a plurality of fluid passages associated with said payload cartridges for transmitting said mechanical force to said chaff, said plurality fluid passages in fluid communication with said firing squibs, said plurality of fluid passages formed in circular symmetry with respect to the longitudinal axis of said multiple chaff deployment cylindrical payload cartridges, said circular symmetry providing for said plurality of firing squibs to be first mounted within said assembly of multiple chaff deployment cylindrical payload cartridges irrespective of the installation orientation of said plurality of firing squibs; and wherein said firing circuit applies a first low voltage electrical signal to a first one of said firing squibs for deploying chaff from one of said multiple chaff deployment payload cartridges and said firing circuit apples a second higher voltage electrical signal to a second one of said plurality of firing squibs for deploying chaff from a second one of said multiple chaff deployment payload cartridges.

2. The chaff deployment device of claim 1, wherein said first low voltage electrical signal and said second low voltage electrical signal are of arbitrary polarity both independently and to one another.

3. The chaff deployment device of claim 1, wherein said first low voltage electrical signal and said second low voltage electrical signal provide controllable inputs for firing said firing squibs at controllably different times.

4. The chaff deployment device of claim 1, wherein firing circuit for generating said first low voltage electrical signal and said second low voltage electrical signal provide an open circuit condition of at least 500 ohms following generation and transmission of said first low voltage electrical signal or said second low voltage electrical signal.

5. The chaff deployment device of claim 1, wherein said firing circuit is voltage polarity insensitive for eliminating errors upon installing said firing squibs to said assembly of multiple chaff deployment cylindrical payload cartridges.

6. The chaff deployment device of claim 1, wherein chaff further comprises objects from the group consisting of electromagnetic radiation absorbing elements, electromagnetic radiation reflecting elements, physical objects for interfering with approaching missiles or other flying devices, glass objects capable of breaking and forming Neff surfaces upon contact with the ground or other objects, and other obstructive objects capable of interfering with attempts to hit or damage the flying vehicle deploying said objects.

7. The chaff deployment device of claim 1, wherein said assembly of multiple chaff deployment cylindrical payload cartridges permits mechanical orientation of said squibs to said cylindrical payload cartridges to be insensitive to cylindrical orientation, thereby eliminating the need for mechanically orienting said squibs to said cylindrical payload cartridges during assembly.

8. The chaff deployment device of claim 1, wherein said assembly of multiple chaff deployment cylindrical payload cartridges permits conversion of a prior existing single payload air expendable decoy device to use said assembly of multiple chaff deployment cylindrical payload cartridges within the existing hardware and software systems of a military vehicle.

9. A method for deploying chaff from an airborne vehicle using a chaff deployment device, comprising the steps of:

receiving and containing chaff for inducing radiofrequency interference upon being deployed by said chaff deployment device using an assembly of multiple chaff deployment cylindrical payload cartridges, said payload cartridges for;

generating a mechanical force for forcing said chaff from said chaff deployment cylindrical payload cartridges using a plurality of firing squibs;

inducing the generation of said mechanical force using a firing circuit for firing said firing squibs;

transmitting said mechanical force to said chaff a plurality of fluid passages associated with said payload cartridges, said plurality fluid passages in fluid communication with said firing squibs, said plurality of fluid passages formed in circular symmetry with respect to the longitudinal axis of said multiple chaff deployment cylindrical payload cartridges, said circular symmetry providing for said plurality of firing squibs to be first mounted within said assembly of multiple chaff deployment cylindrical payload cartridges irrespective of the installation orientation of said plurality of firing squibs; and applying a first low voltage electrical signal to a first one of said firing squibs for deploying chaff from one of said multiple chaff deployment payload cartridges and said firing circuit apples a second higher voltage electrical signal to a second one of said plurality of firing squibs for deploying chaff from a second one of said multiple chaff deployment payload cartridges, using said firing circuit.

10. The method of claim 9, further comprising the step of providing said first low voltage electrical signal and said second low voltage electrical signal at arbitrary polarity both independently and to one another.

11. The method of claim 9, further comprising the step of providing said first low voltage electrical signal and said second low voltage electrical signal provide controllable inputs for firing said firing squibs at controllably different times.

12. The method of claim 9, further comprising the step of generating said first low voltage electrical signal and said second low voltage electrical signal and then establishing in said firing circuit an open circuit condition of at least 500 ohms following generation and transmission of said first low voltage electrical signal or said second low voltage electrical signal.

13. The method of claim 9, further comprising the step of using said firing circuit to provide a voltage polarity insensitive for eliminating errors upon installing said firing squibs to said assembly of multiple chaff deployment cylindrical payload cartridges.

14. The method of claim 9, further comprising the step of providing chaff comprising objects from the group consisting of electromagnetic radiation absorbing elements, electromagnetic radiation reflecting elements, physical objects for interfering with approaching missiles or other flying devices, glass objects capable of breaking and forming Neff surfaces upon contact with the ground or other objects, and other obstructive objects capable of interfering with attempts to hit or damage the flying vehicle deploying said objects.

15. The method of claim 9, further comprising the step of providing permits mechanical orientation of said squibs to said cylindrical payload cartridges so as to be insensitive to cylindrical orientation, thereby eliminating the need for mechanically orienting said squibs to said cylindrical payload cartridges during assembly.

16. The method of claim 9, further comprising the step of providing said assembly of multiple chaff deployment cylindrical payload cartridges permits conversion of a prior existing single payload air expendable decoy device to use said assembly of multiple chaff deployment cylindrical payload cartridges within the existing hardware and software systems of a military vehicle.

17. An airborne military vehicle capable of deploying chaff using a chaff deployment device for deploying chaff from an airborne vehicle, comprising:

an airborne military vehicle for containing a chaff deployment device, said chaff providing multiple chaff deployment capability using a multiple chaff deployment device formed to fit with the physical, electrical, and instructional frame of a single chaff deployment device;

said chaff deployment device, further comprising:

an assembly of multiple chaff deployment cylindrical payload cartridges, said payload cartridges for receiving and containing chaff for inducing radiofrequency interference upon being deployed by said chaff deployment device;

a plurality of firing squibs for generating a mechanical force for forcing said chaff from said chaff deployment cylindrical payload cartridges;

a firing circuit for firing said firing squibs for inducing the generation of said mechanical force;

a plurality of fluid passages associated with said payload cartridges and in fluid communication with said firing squibs, said plurality of fluid passages formed in circular symmetry with respect to the longitudinal axis of said multiple chaff deployment cylindrical payload cartridges, said circular symmetry providing for said plurality of firing squibs to be first mounted within said assembly of multiple chaff deployment cylindrical payload cartridges irrespective of the installation orientation of said plurality of firing squibs; and wherein said firing circuit applies a first low voltage electrical signal to a first one of said firing squibs for deploying chaff from one of said multiple chaff deployment payload cartridges and said firing circuit apples a second higher voltage electrical signal to a second one of said plurality of firing squibs for deploying chaff from a second one of said multiple chaff deployment payload cartridges.

18. The airborne military vehicle of claim 17, wherein said first low voltage electrical signal and said second low voltage electrical signal are of arbitrary polarity both independently and to one another.

19. The airborne military vehicle of claim 17, wherein said first low voltage electrical signal and said second low voltage electrical signal provide controllable inputs for firing said firing squibs at controllably different times.

20. The airborne military vehicle of claim 17, wherein chaff further comprises objects from the group consisting of electromagnetic radiation absorbing elements, electromagnetic radiation reflecting elements, physical objects for interfering with approaching missiles or other flying devices, glass objects capable of breaking and forming Neff surfaces upon contact with the ground or other objects, and other obstructive objects capable of interfering with attempts to hit or damage the flying vehicle deploying said objects.

* * * * *